US006795038B2

(12) United States Patent
Choi

(10) Patent No.: US 6,795,038 B2
(45) Date of Patent: Sep. 21, 2004

(54) INTERFACE CONNECTION CABLE ANTENNA AND ANTENNA DIVERSITY DEVICE OF MOBILE COMMUNICATION TERMINAL USING THE SAME

(75) Inventor: Hong-Giu Choi, Kyongsangbuk-do (KR)

(73) Assignee: Samsung Electronics Co., Ltd. (KR)

( * ) Notice: Subject to any disclaimer, the term of this patent is extended or adjusted under 35 U.S.C. 154(b) by 74 days.

(21) Appl. No.: 10/306,548

(22) Filed: Nov. 27, 2002

(65) Prior Publication Data

US 2003/0098817 A1 May 29, 2003

(30) Foreign Application Priority Data

Nov. 27, 2001 (KR) ..... 2001-74378

(51) Int. Cl.[7] ..... H01Q 1/50
(52) U.S. Cl. ..... 343/906; 343/702; 343/711
(58) Field of Search ..... 343/702, 711, 343/713, 715, 893, 904, 906

(56) References Cited

U.S. PATENT DOCUMENTS 5,777,585 A * 7/1998 Tsuda et al. ..... 343/702
6,029,057 A * 2/2000 Paatelma et al. ..... 455/277.2
6,133,884 A * 10/2000 Talvitie et al. ..... 343/702
2003/0083097 A1 * 5/2003 Kim ..... 455/553

* cited by examiner

*Primary Examiner*—Shih-Chao Chen
(74) *Attorney, Agent, or Firm*—Dilworth & Barrese LLP

(57) ABSTRACT

Disclosed is an interface connection cable antenna installed between a mobile communication terminal and an external terminal to transmit data at high speed, which is capable of easily implementing a desired space diversity in the data transmission. The interface connection cable antenna includes a plug pin plate to be coupled to an external interface connector included in the mobile communication terminal, an interface plug having embedded therein an antenna plug to be coupled to an antenna connector included in the mobile communication terminal, and an antenna connected to the antenna plug via the interface plug, the antenna having a desired length. The interface cable is connected at one end thereof to a connector coupled to a data port included in an external terminal while being provided at the other end thereof with at least one wire connected to the plug pin plate via the interface plug.

12 Claims, 4 Drawing Sheets

INTERFACE CONNECTION CABLE ANTENNA AND ANTENNA DIVERSITY DEVICE OF MOBILE COMMUNICATION TERMINAL USING THE SAME

PRIORITY

This application claims priority to an application entitled "Interface Connection Cable Antenna And Antenna Diversity Device Of Mobile Communication Terminal Using The Same" filed with the Korean Industrial Property Office on Nov. 27, 2001 and assigned Serial No. 2001/74378, the contents of which are hereby incorporated by reference.

BACKGROUND OF THE INVENTION

1. Field of the Invention

The present invention relates to an antenna structure of a mobile communication terminal, and in particular to an interface connection cable antenna and an antenna diversity device of a mobile communication terminal for transmitting and receiving data using the interface connection cable antenna.

2. Description of the Related Art

In accordance with recent development of communication industries, high-speed data rate (HDR) services capable of achieving an improvement in the quality of ultrahigh-speed wireless internet services under the condition in which they are connected with the code division multiple access (CDMA) 2000-1X are being prepared by some mobile communication service providers. Although HDR services do not support voice services, they have a superior data transfer ability to that of existing cable ultrahigh-speed internet services.

HDR services available for CDMA 2000-1X EVDO (Evolution Data Only) services, known as an ultrahigh-speed wireless data communication using a second generation mobile communication network, are classified as a synchronous IMT (International Mobile Telecommunication)-2000 (3G: 3rd Generation) because they have a transfer speed 10 times or more than of the CDMA 2000-1X (IS95C), considered as a 2.5th Generation. Such an HDR scheme is suitable for ultrahigh-speed wireless internet services in that channels dedicated for data are assigned to provide a data rate of 2.4 Mbps at maximum on a forward channel, and a data rate of 153.6 Kbps at maximum on a reverse channel. HDR services may be used to improve the data transfer ability in existing CDMA 2000-1X (IS95C) networks or individual data networks. In existing CDMA networks, part of voice channels are changed into data channels. However, although the HDR scheme allows each channel to be shared by several users in accordance with a combination of a time division multiplexing (TDM) scheme and the CDMA scheme, each user is not allocated with a fixed time slot for the channel, as compared to a time division multiple access (TDMA) scheme. In accordance with the HDR scheme, each user is allocated with the channel only when the channel is to be used. The data rate of HDR optimized for IP (Internet Protocol) packets and Internet access may vary depending on the distance from a mobile communication terminal to a base station.

Accordingly, mobile communication terminals supporting EVDO services can provide services at a data rate of 2 Mbps or more, surpassing that of the cable ultrahigh-speed internet services, so that it is possible to achieve transmission and reception of moving pictures in a real time fashion. Such a mobile communication terminal uses a space diversity scheme using two antennas. That is, this mobile communication terminal has two wireless receiving units in order to minimize loss of receiving information caused by fading. However, a large part of currently available mobile communication terminals have only a single antenna. In this case, where it is desired to implement the space diversity using two antennas, a separate antenna should be installed. However, there is a difficulty in installing such separate antenna because mobile communication terminals have a compact size.

Although the desired space diversity can be implemented in a mobile communication terminal by installing a chip antenna in the mobile communication terminal in a built-in fashion,. in this case, however, the chip antenna exhibits a degraded standing wave ratio. As a result, it is impossible to provide effective high-speed data transmission and reception services to users.

SUMMARY OF THE INVENTION

Therefore, an object of the invention is to provide an external interface connection cable antenna of a mobile communication terminal provided with a diversity antenna.

Another object of the invention is to provide an antenna diversity device of a mobile communication terminal for high-speed data communication services, which can easily implement a desired space diversity using an interface connection cable antenna.

Another object of the invention is to provide an interface connection cable antenna installed between a mobile communication terminal and a data terminal (for example, a computer) to transmit data at high speed, which is capable of easily implementing a desired space diversity in the data transmission.

In accordance with one aspect, the present invention provides an interface connection cable antenna comprising: a plug pin plate to be coupled to an external interface connector included in a mobile communication terminal; an interface plug embedding therein an antenna plug to be coupled to an antenna connector included in the mobile communication terminal; an antenna connected to the antenna plug via the interface plug, the antenna having a desired length; and an interface cable connected at one end thereof to a connector coupled to a data port included in an external terminal while being provided at the other end thereof with at least one wire connected to the plug pin plate via the interface plug.

The antenna may comprise a wire antenna or a loop antenna having a desired length. Alternatively, the antenna may comprise a helical antenna made of a wound coil and embedded in a housing included in the interface plug. The helical antenna may have a structure allowing the helical antenna to be used in a state coupled with a whip.

In accordance with another aspect, the present invention provides an interface connection cable antenna comprising: a plug pin plate to be coupled to an external interface connector included in a mobile communication terminal; an interface plug embedding therein an antenna plug to be coupled to an antenna connector included in the mobile communication terminal; and an interface cable connected at one end thereof to a connector coupled to a data port included in an external terminal, the interface cable including at least one data cable connected to the plug pin plate via the interface plug at the other end of the interface cable, a cable antenna made of a conductive material and arranged around the data cable, the cable antenna being connected to the antenna plug, and a coating layer adapted to protect the cable antenna from surroundings.

A shield layer may be formed between the data cable and the cable antenna in the interface cable.

The antenna may comprise a wire antenna having a desired length or a helical antenna made of a wound coil.

In accordance with another aspect, the present invention provides an antenna diversity device for use in a mobile communication terminal including a terminal body, a first radio frequency part received in the terminal body and adapted to perform transmission and reception of data, and a second radio frequency part for receiving data under a desired control, comprising: an interface connection part interfaced with an external terminal for data communications; an external antenna connector; a switch connected between the external antenna connector and the second radio frequency part, the switch serving to switch on/off the connection between the external antenna connector and the second radio frequency part in response to a switching control signal inputted thereto; a controller connected to the interface connection part, and adapted to sense a connection to an interface cable, thereby supplying the switching control signal to the switch; and the interface cable provided with an antenna connected to an antenna plug coupled to the external antenna connector, and adapted to connect the interface connection part to a data communication port of the external data communication terminal.

The antenna diversity device having the above described configuration for use in a mobile communication terminal operates to receive data at high speed while implementing a desired space diversity by an antenna mounted to the body of the mobile communication terminal and the interface connector cable antenna when the interface connector cable antenna is coupled to the interface connector part of the mobile communication terminal under an HDR service mode.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE PREFERRED EMBODIMENTS

Figure 1:
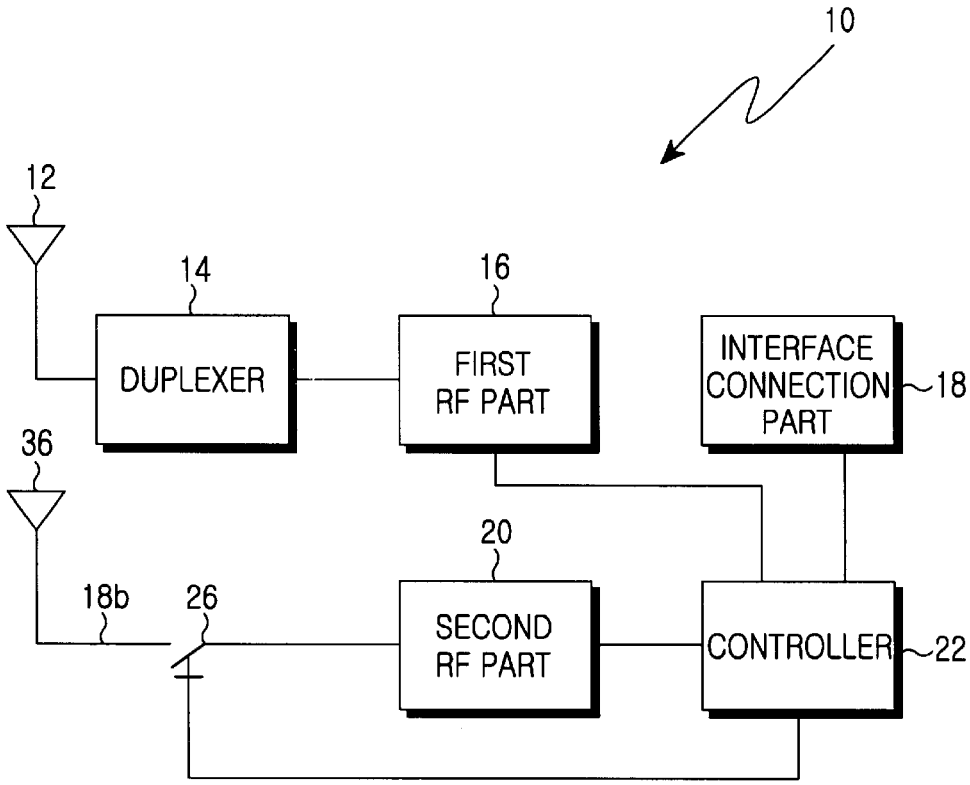
FIG. 1 is a block diagram illustrating a mobile communication terminal according to an embodiment of the present invention.

Now, preferred embodiments of the present invention will be described in detail, with reference to the annexed drawings. In the drawings, the same or similar elements are denoted by the same reference numerals even though they are depicted in different drawings. In the following description of the present invention, a detailed description of known functions and configurations is omitted when to avoid making the subject matter of the present invention unclear.

FIG. 1 is a block diagram illustrating a mobile communication terminal according to an embodiment of the present invention. The mobile communication terminal, which is denoted by the reference numeral 10 in FIG. 1, uses two antennas 12 and 36 adopting a space diversity scheme for HDR services, and a pair of radio frequency (RF) parts, that is, first and second RF parts 16 and 20. The first RF part 16 is a wireless part usable for transmission and reception of data, whereas the second RF part 20 is a wireless part usable only for reception of data. Such a mobile communication terminal configuration for implementing a space diversity using two antennas and two wireless parts is disclosed in detail in Korean Patent Application No. 2001-66885 filed on Oct. 29, 2001 by the applicant. Accordingly, the following description will be given only in conjunction with the configuration of an interface connection cable antenna according to the present invention, and antenna connecting operations in the case in which the interface cable is coupled to an interface connection part provided at a mobile communication terminal.

In FIG. 1, the reference numeral 14 denotes a duplexer, and the reference numeral 18 denotes an interface connection part. The interface connection part 18 includes a data connector, and an antenna connector 18*b*. The reference numeral 22 denotes a controller for sensing insertion of an interface connector adapted to interface the interface connection part 18 to an external terminal for data communications, and controlling a switch 26 connected to the second RF part 20 in response to the sensed insertion, thereby controlling connection of an external antenna 36. The controller 22 receives and transmits data associated with the interface connection part 18 via the first and second RF parts 16 and 20. In this case, the external antenna 36 is installed at the interface connection cable antenna configured as shown in FIG. 2 or 3 and used to connect the mobile communication terminal 10 to the external terminal for high-speed data communication, via an interface plug 30 provided at the interface cable 40.

In the mobile communication terminal 10 configured as shown in FIG. 1, when the interface connection cable antenna interfacing the mobile communication terminal 10 with the external terminal is connected to the interface connection part 18, the controller 22 switches on (i.e. closes) the switch 26, thereby executing a space diversity operation for connecting the external antenna 36, installed at the plug 30 of a interface cable 40 (as shown in the embodiment depicted in FIG. 2), to the second RF part 20, thereby allowing transmission and reception of data at high speed.

In this case, one of the two antennas is installed at the externally positioned interface connection cable antenna. Accordingly, there is an advantage in that it is unnecessary to modify the compact structure of the mobile communication terminal.

Figure 2:
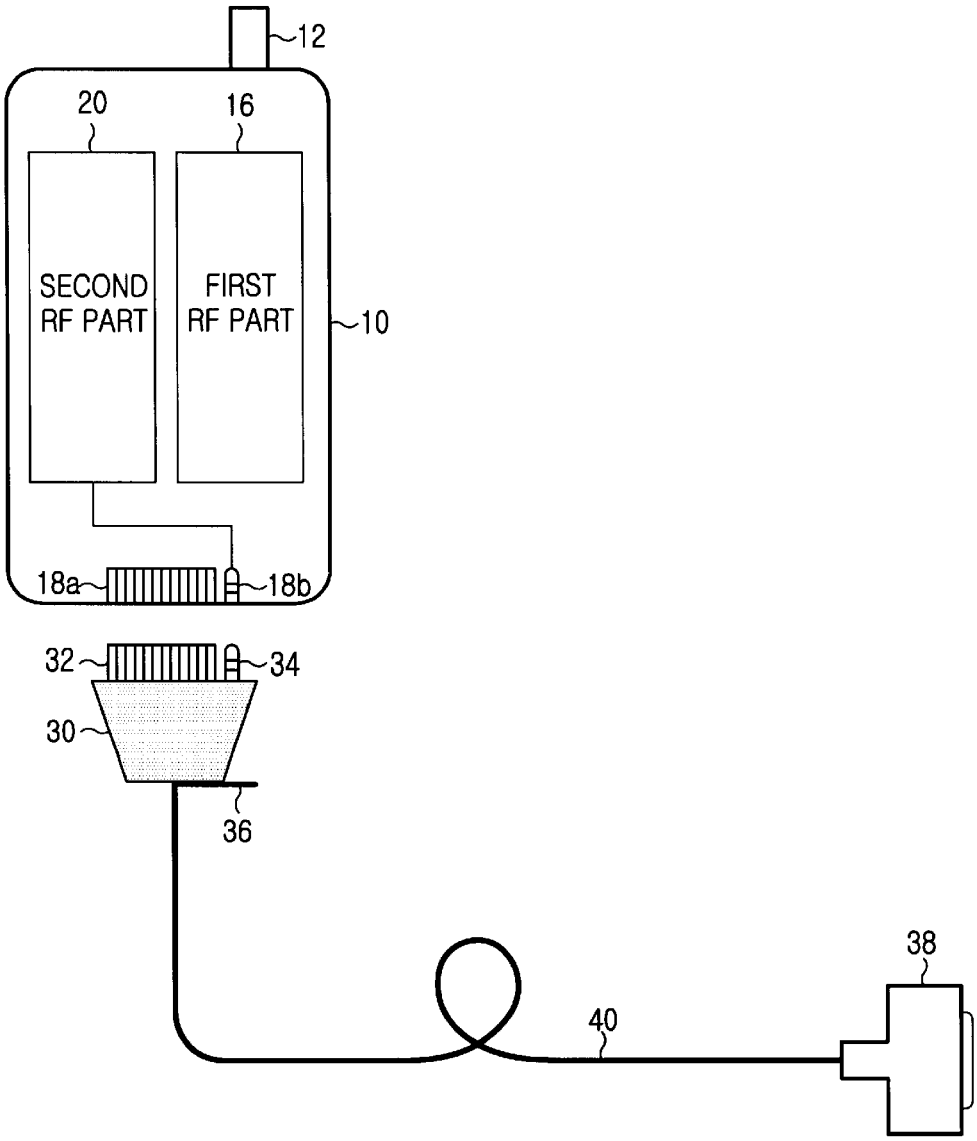
FIG. 2 is a view illustrating an interface connection cable antenna for reception of data at high speed in accordance with a preferred embodiment of the present invention, and a connectable state of the interface connection cable antenna to the mobile communication terminal.
Figure 3:
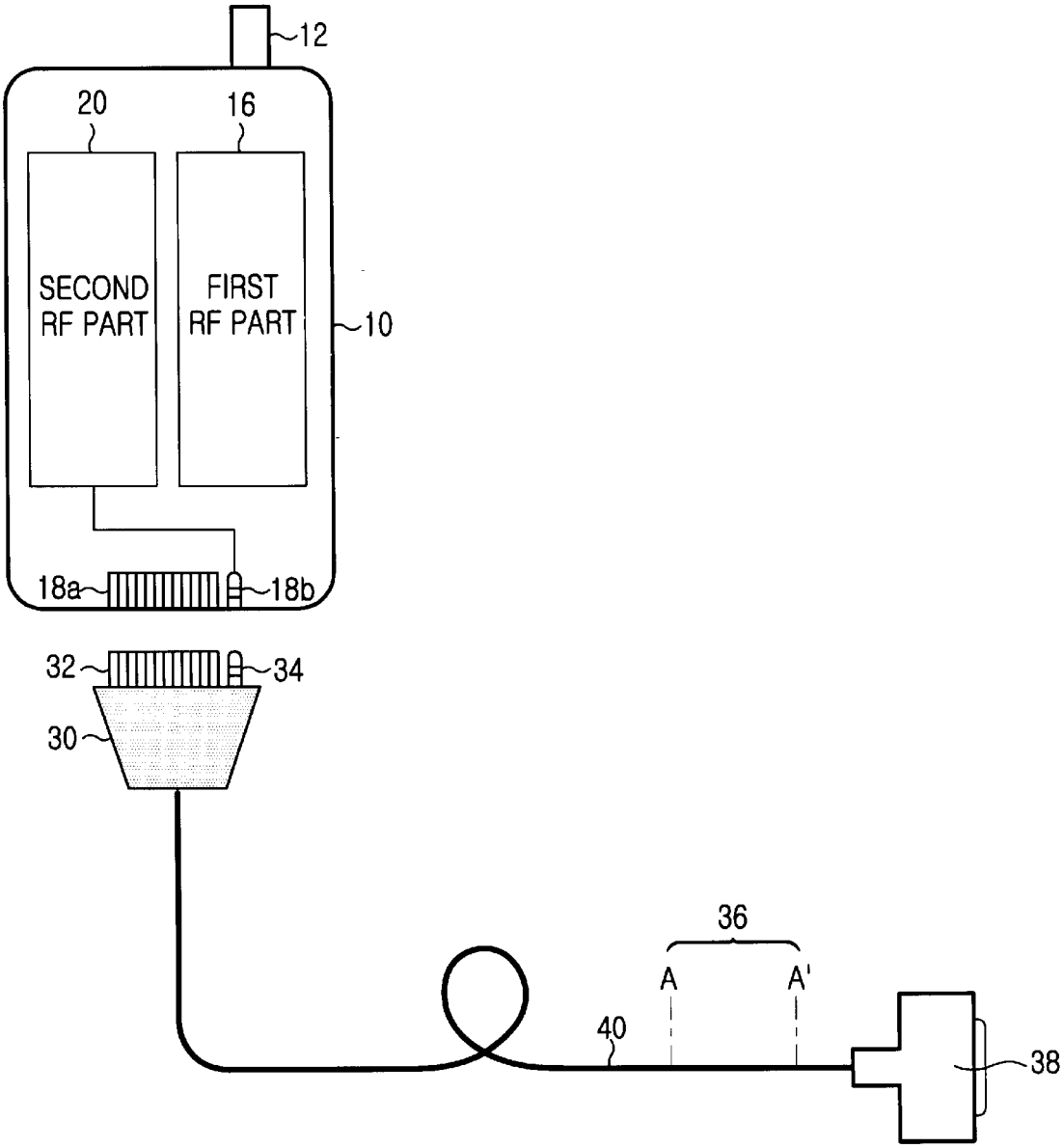
FIG. 3 is a view illustrating an interface connection cable antenna for reception of data at high speed in accordance with another preferred embodiment of the present invention.

FIG. 2 illustrates the interface connection cable antenna for reception of data at high speed in accordance with a preferred embodiment of the present invention, and a connectable state of the interface connection cable antenna to a mobile communication terminal. In FIG. 2, the reference numerals 18*a* and 18*b* denote portions of the interface connection part 18 shown in FIG. 1. The reference numeral 18*a* denotes a plug connector for receiving a plug pin plate 32 provided at one end of the interface cable 40, whereas the reference numeral 18*b* denotes the antenna connector for receiving an antenna plug 34 provided at the end of the interface cable 40. As shown in FIG. 1, the antenna connector 18*b* is connected to the second RF part 20 via the switch 26. An outwardly protruded external antenna 36 is attached to the plug 30. The external antenna 36 is electrically connected to the antenna plug 34 coupled to the plug 30. The external antenna 36 shown in FIG. 2 can have the form of a line cord, loop, or wire. This external antenna 36 has a desired length corresponding to receiving radio waves. The external antenna 36 may be embedded in the plug 30 in a state in which it is wound in the form of a helical coil. The helical antenna may have a structure allowing the helical antenna to be used in a state coupled with a whip.

As the plug 30 of the interface connection cable antenna configured as shown in FIG. 2 is coupled to the external interface connection part 18 configured as shown in FIG. 1, the plug pin plate 32 and antenna plug 34 of the plug 30 are connected to the plug connector 18*a* and antenna connector 18*b* of the mobile communication terminal 10, respectively. This connection is sensed by a plug sensor included in the interface connection part 18. Upon sensing the connection, the plug sensor sends a sensing signal to the controller 22 which, in turn, switches on the switch 26. Thus, it is possible to easily implement a desired antenna diversity using the cable antenna having the above described configuration. Therefore, a desired space diversity for the mobile communication terminal can be easily implemented without using any separate antenna mounted to the mobile communication terminal.

FIG. 3 illustrates an interface connection cable antenna for reception of data at high speed in accordance with another preferred embodiment of the present invention. The configuration of FIG. 3 is similar to that of FIG. 2, except that a wire type antenna or a helical antenna with a helically-wound coil, as a cable antenna 36, is embedded in the interface cable 40. For example, the same diversity as that of FIG. 2 can be implemented by connecting the helical antenna 36 embedded in the interface cable 40 to the antenna plug 34. This configuration can be more easily understood by referring to FIG. 4.

Figure 4:
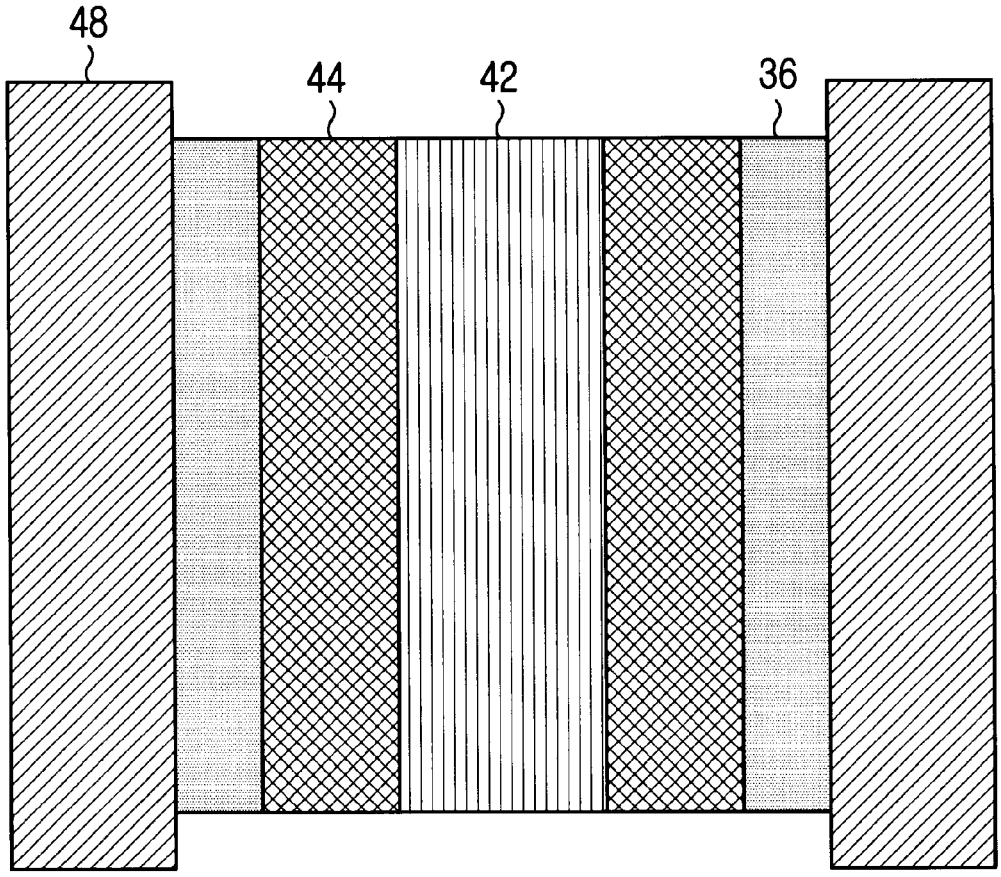
FIG. 4 is a cross-sectional view illustrating the cable antenna shown in FIG. 3.

FIG. 4 is a cross-sectional view illustrating the cable antenna 36 shown in FIG. 3. Referring to FIG. 4, a plurality of data cables 42 are arranged at the central portion of the cable antenna. The data cables 42 connect various pins formed at the plug pin plate 32 embedded in the plug 30 with pins formed at a terminal-end connector 38 coupled to a data communication port included in an external terminal, for example, a computer.

A shield layer 44 is formed around the data cables 42 in order to prevent an interference between high-speed data signals transmitted via the data cables 42 and signals received by the cable antenna 36. The cable antenna 36, which is made of a conductor, is formed around the shield layer 44, and is electrically connected to the antenna plug 34 provided at the plug 30. Although the cable antenna 36 may be formed by simply coating a conductor, it can also be made by helically winding a coil. A coating layer 48 is formed around the cable antenna 36 in order to protect the cable 40. Thus, the cable antenna of FIG. 3 can be configured without any separate configuration requiring additional space. Accordingly, there is a convenience in use.

As apparent from the above description, an antenna is installed in an interface connection cable for interfacing a mobile communication terminal with an external terminal in accordance with the present invention. When a desired antenna diversity is implemented by connecting the interface connection cable antenna to a mobile communication terminal enabling HDR services, it is possible to achieve more efficient HDR services.

While this invention has been described in connection with what is presently considered to be the most practical and preferred embodiments, it is to be understood that the invention is not limited to the disclosed embodiments, but, on the contrary, it is intended to cover various modifications within the spirit and scope of the appended claims.

What is claimed is:

1. An interface connection cable antenna comprising:

a plug pin plate to be coupled to an external interface connector included in a mobile communication terminal;

an interface plug having embedded therein an antenna plug to be coupled to an antenna connector included in the mobile communication terminal;

an antenna connected to the antenna plug via the interface plug; and an interface cable connected at one end thereof to a connector to be coupled to a data port included in an external terminal, while being provided at the other end thereof with at least one wire connected to the plug pin plate via the interface plug.

2. The interface connection cable antenna according to claim 1, wherein the antenna comprises a wire antenna or a loop antenna having a desired length.

3. The interface connection cable antenna according to claim 1, wherein the antenna comprises a helical antenna made of a wound coil and embedded in a housing included in the interface plug.

4. The interface connection cable antenna according to claim 3, wherein the helical antenna has a structure allowing the helical antenna to be used in a state coupled with a whip.

5. An interface connection cable antenna comprising:

a plug pin plate to be coupled to an external interface connector included in a mobile communication terminal;

an interface plug having embedded therein an antenna plug to be coupled to an antenna connector included in the mobile communication terminal; and an interface cable connected at one end thereof to a connector to be coupled to a data port included in an external terminal, the interface cable including at least one data cable connected to the plug pin plate via the interface plug at the other end of the interface cable, a cable antenna made of a conductive material and arranged around the data cable, the cable antenna being connected to the antenna plug, and a coating layer adapted to protect the cable antenna.

6. The interface connection cable antenna according to claim 5, wherein the interface cable further includes a shield layer formed between the data cable and the cable antenna.

7. The interface connection cable antenna according to claim 5, wherein the cable antenna comprises a helical antenna.

8. The interface connection cable antenna according to claim 6, wherein the helical antenna comprises a wound coil.

9. An antenna diversity device for use in a mobile communication terminal including a terminal body, a first radio frequency part received in the terminal body and adapted to perform transmission and reception of data, and a second radio frequency part for receiving data under a desired control, comprising:

an interface connection part for interfacing with an external terminal for data communications;

an antenna connector;

a switch connected between the antenna connector and the second radio frequency part, the switch serving to switch on/off the connection between the antenna connector and the second radio frequency part in response to a switching control signal inputted thereto; and a controller connected to the interface connection part, and adapted to sense a connection to an interface connection cable antenna, thereby supplying the switching control signal to the switch; wherein the interface connection cable antenna is provided with an antenna plug to be coupled to the external antenna connector, and is adapted to connect the interface connection part to a data communication port of an external data communication terminal.

10. The antenna diversity device according to claim 9, wherein the interface connection cable antenna further comprises:

an interface plug including a plug pin plate adapted to be coupled to the interface connection part;

an antenna connected to the antenna plug via the interface plug, the antenna having a desired length; and an interface cable connected at one end thereof to a connector coupled to the data communication port included in the external terminal while being provided at the other end thereof with at least one wire connected to the plug pin plate via the interface plug.

11. The antenna diversity device according to claim 10, wherein the antenna comprises a wire antenna or a loop antenna having a desired length.

12. The antenna diversity device according to claim 9, wherein the interface connection cable antenna comprises:

an interface plug including a plug pin plate adapted to be coupled to the interface connection part;

the antenna plug coupled to the antenna connector of the mobile communication terminal; and an interface cable connected at one end thereof to a connector coupled to the data communication port included in the external terminal, the interface cable including at least one data cable connected to the plug pin plate via the interface plug at the other end of the interface cable, a cable antenna made of a conductive material and arranged around the data cable, the cable antenna being connected to the antenna plug, and a coating layer adapted to protect the cable antenna.

* * * * *